US007754958B2

(12) United States Patent
Goto et al.

(10) Patent No.: US 7,754,958 B2
(45) Date of Patent: Jul. 13, 2010

(54) SOUND ANALYSIS APPARATUS AND PROGRAM

(75) Inventors: Masataka Goto, Tsukuba (JP); Takuya Fujishima, Hamamatsu (JP); Keita Arimoto, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 521 days.

(21) Appl. No.: 11/849,232

(22) Filed: Aug. 31, 2007

(65) Prior Publication Data

US 2008/0053295 A1 Mar. 6, 2008

(30) Foreign Application Priority Data

Sep. 1, 2006 (JP) ..... 2006-237274

(51) Int. Cl.
*G10H 1/00* (2006.01)

(52) U.S. Cl. ..... 84/616; 84/609; 84/610; 84/611; 84/615; 84/649; 84/650; 84/651; 84/653; 84/654

(58) Field of Classification Search ..... None
See application file for complete search history.

(56) References Cited

U.S. PATENT DOCUMENTS

| | | | | |
|---|---|---|---|---|
| 2001/0045153 | A1 | 11/2001 | Alexander et al. | |
| 2008/0097754 | A1* | 4/2008 | Goto et al. | 704/214 |
| 2008/0202321 | A1* | 8/2008 | Goto et al. | 84/616 |
| 2008/0262836 | A1* | 10/2008 | Goto et al. | 704/207 |
| 2008/0312913 | A1* | 12/2008 | Goto | 704/207 |

FOREIGN PATENT DOCUMENTS

| | | |
|---|---|---|
| JP | 3413634 | 5/2001 |
| WO | WO-2005/066927 | 7/2005 |

OTHER PUBLICATIONS

Goto, M., "A Real-Time Music-Scene-Description System: Predominant-F0 Estimation For Detecting Melody and Bass Lines in Real-World Audio Signals", Speech Communication, 43, 2004, pp. 311-329.

Goto, Masataka, A Robust Predominant-F0 Estimation Method for Real-Time Detection of Melody and Bass Lines in CD Recordings, Electrotechnical Laboratory, 2000 IEEE International Conference on Acoustics, Speech and Signal Processing Proceedings, pp. II-757-760, Jun. 2000.

(Continued)

*Primary Examiner*—Marlon T Fletcher
(74) *Attorney, Agent, or Firm*—Morrison & Foerster LLP

(57) ABSTRACT

A sound analysis apparatus stores sound source structure data defining a constraint on one or more of sounds that can be simultaneously generated by a sound source of an input audio signal. A form estimation part selects fundamental frequencies of one or more of sounds likely to be contained in the input audio signal with peaked weights from various fundamental frequencies during sequential updating and optimizing of weights of tone models corresponding to the various fundamental frequencies, so that the sounds of the selected fundamental frequencies satisfy the sound source structure data, and creates form data specifying the selected fundamental frequencies. A previous distribution imparting part imparts a previous distribution to the weights of the tone models corresponding to the various fundamental frequencies so as to emphasize weights corresponding to the fundamental frequencies specified by the form data created by the form estimation part.

13 Claims, 8 Drawing Sheets

OTHER PUBLICATIONS

Goto, Masataka, A Predominant-F0 Estimation Method for CD Recordings: Map Estimation Using EM Algorithm for Adaptive Tone Models, Information and Human Activity, PRESTO, Japan Science and Technology Corporatin, pp. 3365-3368, IEEE, 2001.

Kitahara, Tetsuro, et al., Musical Instrument Identification Based on F0-Dependent Multivariate Normal Distribution, Department of Intelligence Science and Engineering, IEEE International Conference on Acoustics, Speech and Signal Processing, pp. III-409 to III-412, Apr. 6, 2003.

Goto, A Real-Time Music-Scene-Description System: Predominant-F0 Estimation for Detecting Melody and Bass Lines in Real-World Audio signals, National Institute of Advanced Industrial Science and Technology, pp. 311-329, Mar. 13, 2004.

* cited by examiner

SOUND ANALYSIS APPARATUS AND PROGRAM

BACKGROUND OF THE INVENTION

1. Technical Field of the Invention

The present invention relates to a sound analysis apparatus and program that estimates pitches (which denotes fundamental frequencies in this specification) of melody and bass sounds in a musical audio signal, which collectively includes a vocal sound and a plurality of types of musical instrument sounds, the musical audio signal being contained in a commercially available compact disc (CD) or the like.

2. Description of the Related Art

It is very difficult to estimate the pitch of a specific sound source in a monophonic audio signal in which sounds of a plurality of sound sources are mixed. One substantial reason why it is difficult to estimate a pitch in a mixed sound is that the frequency components of one sound overlap those of another sound played at the same time in the time-frequency domain. For example, a part (especially, the fundamental frequency component) of the harmonic structure of a vocal sound, which carries the melody, in a piece of typical popular music played with a keyboard instrument (such as a piano), a guitar, a bass guitar, a drum, etc., frequently overlaps harmonic components of the keyboard instrument and the guitar or high-order harmonic components of the bass guitar, and noise components included in sounds of a snare drum or the like. For this reason, techniques of locally tracking each frequency component do not reliably work for complex mixed sounds. Some techniques estimate a harmonic structure with the assumption that fundamental frequency components are present. However, these techniques have a serious problem in that they do not address the missing fundamental phenomenon. Also, these techniques are not effective when the fundamental frequency components overlap frequency components of another sound played at the same time.

Although, for this reason, some conventional technologies estimate a pitch in an audio signal containing a single sound alone or a single sound with aperiodic noise, no technology has been provided to estimate a pitch in a mixture of a plurality of sounds such as an audio signal recorded in a commercially available CD.

However, a technology to appropriately estimate the pitches of sounds included in a mixed sound using a statistical technique has been proposed recently. This technology is described in Japanese Patent Registration No. 3413634.

In the technology of Japanese Patent Registration No. 3413634, frequency components in a frequency range which is considered that of a melody sound and frequency components in a frequency range which is considered that of a bass sound are separately obtained from an input audio signal using BPFs and the fundamental frequency of each of the melody and bass sounds is estimated based on the frequency components of the corresponding frequency range.

More specifically, the technology of Japanese Patent Registration No. 3413634 prepares tone models, each of which has a probability density distribution corresponding to the harmonic structure of a corresponding sound, and assumes that the frequency components of each of the frequency ranges of the melody and bass sounds have a mixed distribution obtained by weighted mixture of tone models corresponding respectively to a variety of fundamental frequencies. The respective weights of the tone models are estimated using an Expectation-Maximization (EM) algorithm.

The EM algorithm is an iterative algorithm which performs maximum-likelihood estimation of a probability model including a hidden variable and thus can obtain a local optimal solution. Since a probability density distribution with the highest weight can be considered that of a harmonic structure that is most dominant at the moment, the fundamental frequency of the most dominant harmonic structure can then be determined to be the pitch. Since this technique does not depend on the presence of fundamental frequency components, it can appropriately address the missing fundamental phenomenon and can obtain the most dominant harmonic structure regardless of the presence of fundamental frequency components.

However, such a simply determined pitch may be unreliable since, if peaks corresponding to fundamental frequencies of sounds played at the same time are competitive in a fundamental frequency probability density function, these peaks may be selected in turns as the maximum value of the probability density function. Thus, to estimate a fundamental frequency from a broad viewpoint, the technology of Japanese Patent Registration No. 3413634 successively tracks the trajectory of a plurality of peaks in the fundamental frequency probability density function as the function changes with time, and selects a fundamental frequency trajectory, which is most dominant and reliable (or stable), from the tracked trajectories. A multi-agent model has been introduced to dynamically and flexibly control this tracking process.

The multi-agent model includes one salience detector and a plurality of agents. The salience detector detects salient peaks that are prominent in the fundamental frequency probability density function. The agents are activated basically to track the trajectories of the peaks. That is, the multi-agent model is a general-purpose framework that temporally tracks features that are prominent in an input audio signal.

However, the technology described in Japanese Patent Registration No. 3413634 has a problem in that every frequency in the pass range of the BPF may be estimated to be a fundamental frequency. For example, when an input audio signal is generated by playing a specific musical instrument, we cannot exclude the possibility that the fundamental frequency of a false sound which could not be generated by playing the musical instrument is erroneously estimated to be a fundamental frequency in the input audio signal.

SUMMARY OF THE INVENTION

The present invention has been made in view of the above circumstances and it is an object of the present invention to provide a sound analysis apparatus and program that estimates a fundamental frequency probability density function of an input audio signal using an EM algorithm, and uses previous knowledge specific to a musical instrument to obtain the fundamental frequencies of sounds generated by the musical instrument, thereby allowing accurate estimation of the fundamental frequencies of sounds generated by the musical instrument.

In accordance with the present invention, there are provided a sound analysis apparatus and a sound analysis program that is a computer program causing a computer to function as the sound analysis apparatus. The sound analysis apparatus is designed for analyzing an input audio signal based on a weighted mixture of a plurality of tone models which represent harmonic structures of sound sources and which correspond to probability density functions of various fundamental frequencies. The sound analysis apparatus comprises: a probability density estimation part that sequentially updates and optimizes respective weights of the plurality of the tone models, so that a mixed distribution of frequencies obtained by the weighted mixture of the plurality of the tone models corresponding respectively to the various fundamental frequencies approximates an actual distribution of frequency components of the input audio signal, and that estimates the optimized weights of the tone models to be a fundamental frequency probability density function of the various fundamental frequencies corresponding to the sound sources; and a fundamental frequency determination part that determines an actual fundamental frequency of the input audio signal based on the fundamental frequency probability density function estimated by the probability density estimation part.

In a first aspect of the invention, the probability density estimation part comprises: a storage part that stores sound source structure data defining a constraint on one or more of sounds that can be simultaneously generated by a sound source of the input audio signal; a form estimation part that selects fundamental frequencies of one or more of sounds likely to be contained in the input audio signal with peaked weights from the various fundamental frequencies during the sequential updating and optimizing of the weights of the tone models corresponding to the various fundamental frequencies, so that the sounds of the selected fundamental frequencies-satisfy the sound source structure data, and that creates form data specifying the selected fundamental frequencies; and a previous distribution imparting part that imparts a previous distribution to the weights of the tone models corresponding to the various fundamental frequencies so as to emphasize weights corresponding to the fundamental frequencies specified by the form data created by the form estimation part.

Preferably, the probability density estimation part further includes a part for selecting each fundamental frequency specified by the form data, setting a weight corresponding to the selected fundamental frequency to zero, performing a process of updating the weights of the tone models corresponding to the various fundamental frequencies once, and excluding the selected fundamental frequency from the fundamental frequencies of the sounds that are estimated to be likely to be contained in the input audio signal if the updating process makes no great change in the weights of the tone models corresponding to the various fundamental frequencies.

In accordance with a second aspect of the present invention, the fundamental frequency determination part comprises: a storage part that stores sound source structure data defining a constraint on one or more of sounds that can be simultaneously generated by a sound source of the input audio signal; a form estimation part that selects, from the various fundamental frequencies, fundamental frequencies of one or more of sounds which have weights peaked in the fundamental frequency probability density function estimated by the probability density estimation part and which are estimated to be likely contained in the input audio signal so that the selected fundamental frequencies satisfy the constraint defined by the sound source structure data, and that creates form data representing the selected fundamental frequencies; and a determination part that determines the actual fundamental frequency of the input audio signal based on the form data.

In accordance with a third aspect of the present invention, the probability density estimation part comprises: a storage part that stores sound source structure data defining a constraint on one or more of sounds that can be simultaneously generated by a sound source of the input audio signal; a first update part that updates the weights of the tone models corresponding to the various fundamental frequencies a specific number of times for approximating the frequency components of the input audio signal; a fundamental frequency selection part that obtains fundamental frequencies with peaked weights based on the weights updated by the first update part from the various fundamental frequencies and that selects fundamental frequencies of one or ore more sounds likely to be contained in the input audio signal from the obtained fundamental frequencies with the peaked weights so that the selected fundamental frequencies satisfy the constraint defined by the sound source structure data; and a second update part that imparts a previous distribution to the weights of the tone models corresponding to the various fundamental frequencies so as to emphasize the weights corresponding to the fundamental frequencies selected by the fundamental frequency selection part, and that updates the weights of the tone models corresponding to the various fundamental frequencies a specific number of times for further approximating the frequency components of the input audio signal.

Preferably, the probability density estimation part further includes a third update part that updates the weights, updated by the second update part, of the tone models corresponding to the various fundamental frequencies a specific number of times for further approximating the frequency components of the input audio signal, without imparting the previous distribution.

In accordance with the first, second and third aspects of the invention, the sound analysis apparatus and the sound analysis program emphasizes a weight corresponding to a sound that is likely to have been played among weights of tone models corresponding to a variety of fundamental frequencies, based on sound source structure data that defines constraints on one or a plurality of sounds which can be simultaneously generated by a sound source, thereby allowing accurate estimation of the fundamental frequencies of sounds contained in the input audio signal.

DETAILED DESCRIPTION OF THE INVENTION

Embodiments of the present invention will now be described with reference to the drawings.

First Embodiment

Overall Configuration

Figure 1:
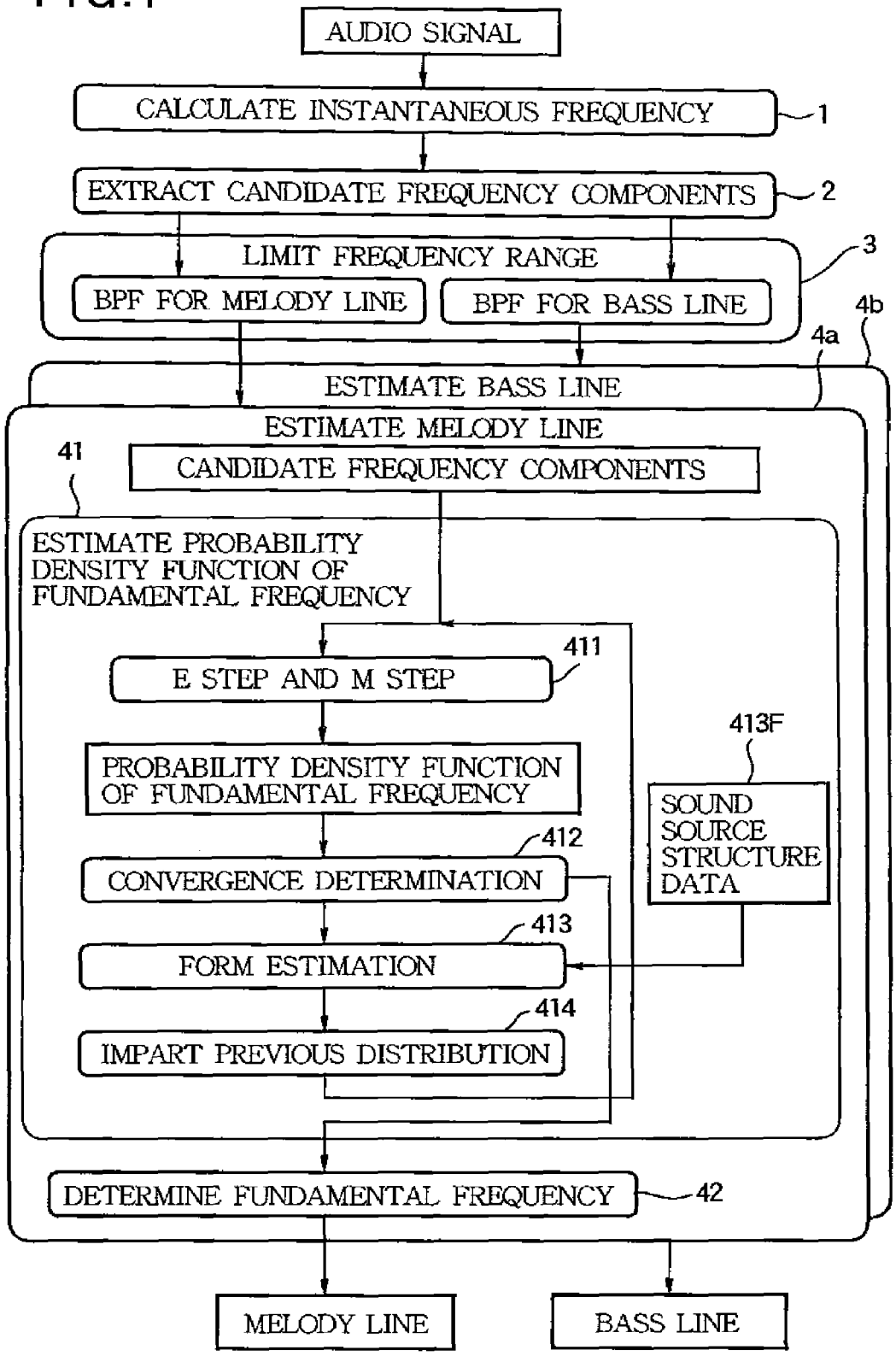
FIG. 1 illustrates processes of a sound analysis program according to a first embodiment of the present invention.

FIG. 1 illustrates processes of a sound analysis program according to a first embodiment of the present invention. The sound analysis program is installed and executed on a computer such as a personal computer that has audio signal acquisition functions such as a sound collection function to obtain audio signals from nature, a player function to reproduce musical audio signals from a recording medium such as a CD, and a communication function to acquire musical audio signals through a network. The computer, which executes the sound analysis program according to this embodiment, functions as a sound analysis apparatus according to this embodiment.

The sound analysis program according to this embodiment estimates the pitches of a sound source included in a monophonic musical audio signal obtained through the audio signal acquisition function. The most important example in this embodiment is estimation of a melody line and a bass line. The melody is a series of notes more distinctive than others and the bass is a series of lowest ones of the ensemble notes. A course of the temporal change of the melody note and a course of the temporal change of the bass note are referred to as a melody line Dm(t) and a bass line Db(t), respectively. When Fi(t)(i=m,b) is a fundamental frequency F0 at time t and Ai(t) is its amplitude, the melody line Dm(t) and the bass line Db(t) are expressed as follows.

$$Dm(t)=\{Fm(t),Am(t)\} \quad \text{[Expression 1]}$$

$$Db(t)=\{Fb(t),Ab(t)\} \quad \text{[Expression 2]}$$

The sound analysis program includes respective processes of instantaneous frequency calculation 1, candidate frequency component extraction 2, frequency range limitation 3, melody line estimation 4*a* and bass line estimation 4*b* as means for obtaining the melody line Dm(t) and the bass line (Db)(t) from the input audio signal. Each of the processes of the melody line estimation 4*a*, and the bass line estimation 4*b* includes fundamental frequency probability density function estimation 41 and fundamental frequency determination 42. The processes of the instantaneous frequency calculation 1, the candidate frequency component extraction 2, and the frequency range limitation 3 in this embodiment are basically the same as those described in Japanese Patent Registration No. 3413634. This embodiment is characterized by the processes of the melody line estimation 4*a* and the bass line estimation 4*b* among the processes of the sound analysis program. Specifically, this embodiment is characterized in that successive tracking of fundamental frequencies according to the multi-agent model employed in Japanese Patent Registration No. 3413634 is omitted and instead an improvement is made to the processes of the fundamental frequency probability density function estimation 41 and the fundamental frequency determination 42. A description will now be given of the processes of the sound analysis program according to this embodiment.

<<Instantaneous Frequency Calculation 1>>

This process provides an input audio signal to a filter bank including a plurality of BPFs and calculates an instantaneous frequency (which is the time derivative of the phase) of an output signal of each BPF of the filter bank (see J. L. Flanagan and R. M. Golden, "phase vocoder," Bell System Technical Journal. Vol. 45, pp. 1493-1509, 1966). Here, a Short Time Fourier Transform (STFT) output is interpreted as an output of the filter bank using the Flanagan method to efficiently calculate the instantaneous frequency. When STFT of an input audio signal x(t) using a window function h(t) is expressed by Expressions 3 and 4, an instantaneous frequency λ(ω,t) can be obtained using Expression 5.

$$X(\omega, t) = \int_{-\infty}^{+\infty} x(\tau)h(t-\tau)e^{-j\omega\tau}\,d\tau \quad \text{[Expression 3]}$$

$$= a + jb \quad \text{[Expression 4]}$$

$$\lambda(\omega, t) = \omega + \frac{a\frac{\partial b}{\partial t} - b\frac{\partial a}{\partial t}}{a^2 + b^2} \quad \text{[Expression 5]}$$

Here, "h(t)" is a window function that provides time-frequency localization. Examples of the window function include a time window created by convoluting a Gauss function that provides optimal time-frequency localization with a second-order cardinal B-spline function.

Wavelet transform may also be used to calculate the instantaneous frequency. Although we here use STFT to reduce the amount of computation, using the STFT alone may degrade time or frequency resolution in a frequency band. Thus, a multi-rate filter bank is constructed (see M. Vetterli, "A Theory of Multirate Filter Banks," TEEE Trans. on ASSP, Vol. ASSP-35, No. 3, pp. 355-372, 1987) to obtain time-frequency resolution at an appropriate level under the constraint that it can run in real time.

<<Candidate Frequency Component Extraction 2>>

This process extracts candidate frequency components based on the mapping from the center frequency of the filter to the instantaneous frequency (see F. J. Charpentier, "Pitch detection using the short-term phase spectrum," Proc. of ICASSP 86, pp. 113-116, 1986). We here consider the mapping from the center frequency (of an STFT filter to the instantaneous frequency (((,t) of its output. Then, if a frequency component of frequency (is present, (is located at a fixed point of this mapping and the values of its neighboring instantaneous frequencies are almost constant. That is, instantaneous frequencies (f(t) of all frequency components can be extracted using the following equation.

$$\Psi_f^{(t)} = \left\{\Psi \mid \lambda(\phi, t) - \phi = 0,\ \frac{\partial}{\partial\phi}(\lambda(\phi, t) - \phi) < 0\right\} \quad \text{[Expression 6]}$$

Since the power of each of the frequency components is obtained as a value of the STFT power spectrum at each frequency of $\psi_f^{(t)}$, we can define a frequency component power distribution function $\psi_p^{(t)}(\omega)$ by the following equation.

$$\Psi_p^{(t)}(\omega) = \begin{cases} |X(\omega, t)| & \text{if } \omega \in \Psi_f^{(t)} \\ 0 & \text{otherwise} \end{cases} \quad \text{[Expression 7]}$$

<<Frequency Band Limitation 3>>

This process limits a frequency band by weighting the extracted frequency components. Here, two types of BPFs for melody and bass lines are prepared. The BPF for melody lines passes main fundamental frequency components of typical melody lines and most of their harmonic components and blocks, to a certain extent, frequency bands in which overlapping frequently occurs in the vicinity of the fundamental frequencies. On the other hand, the BFP for bass lines passes main fundamental frequency components of typical bass lines and most of their harmonic components and blocks, to a certain extent, frequency bands in which other playing parts are dominant over the bass line.

In this embodiment, the log-scale frequency is expressed in cent (which is a unit of measure to express musical intervals (pitches)) and the frequency fHz expressed in Hz is converted to the frequency fcent expressed in cent as follows.

$$f_{cent} = 1200\log_2 \frac{f_{\mathrm{Hz}}}{REF_{\mathrm{Hz}}} \quad \text{[Expression 8]}$$

$$REF_{\mathrm{Hz}} = 440 \times 2^{\frac{3}{12}-5} \quad \text{[Expression 9]}$$

One semitone of equal temperament corresponds to 100 cents and one octave corresponds to 1200 cents.

When BPFi(x)(i=m,b) denotes the frequency response of a BPF at a frequency of x cents and $\psi'_p{}^{(t)}(x)$ denotes a frequency component power distribution function, frequency components that have passed through the BPF can be expressed by BPFi(x) $\psi'_p{}^{(t)}(x)$. However, $\psi'_p{}^{(t)}(x)$ is the same function as $\psi_p{}^{(t)}(\omega)$ except that the frequency axis is expressed in cent. As a preparation for the next step, we here define a probability density function $p_\psi{}^{(t)}(x)$ of the frequency components that have passed through the BPF.

$$p_\Psi^{(t)}(x) = \frac{BPFi(x)\Psi'^{(t)}_p(x)}{Pow^{(t)}} \quad \text{[Expression 10]}$$

Here, $Pow^{(t)}$ is the sum of the powers of the frequency components that have passed through the BPF as shown in the following equation.

$$Pow^{(t)} = \int_{-\infty}^{+\infty} BPFi(x)\Psi'_p{}^{(t)}(x)dx \quad \text{[Expression 11]}$$

<<Fundamental Frequency Probability Density Function Estimation 41>>

For candidate frequency components that have passed through a BPF, this process obtains a probability density function of each fundamental frequency whose harmonic structure is relatively dominant to some extent. To accomplish this, we assume in this embodiment that the probability density function $p_\psi{}^{(t)}(x)$ of the frequency components has been created from a mixed distribution model (weighted sum model) of probability distributions (tone models) obtained by modeling sounds, each having a harmonic structure. When p(x|F) represents a probability density function of a tone model for fundamental frequency F, the mixed distribution model $p(x; \theta^{(t)})$ can be defined by the following equation.

$$p(x;\theta^{(t)}) = \int_{-\infty}^{+\infty} w^{(t)}(F)_p(x|F)dF \quad \text{[Expression 12]}$$

$$\theta^{(t)} = \{w^{(t)}(F) | Fli \leqq F \leqq Fhi\} \quad \text{[Expression 13]}$$

Here, Fhi and Fli are upper and lower limits of the permissible fundamental frequency and are determined by the pass band of the BPF. And, $w^{(t)}(F)$ is a weight for the tone model p(x|F) which satisfies the following equation.

$$\int_{Fli}^{Fhi} w^{(t)}(F)\,dF = 1 \quad \text{[Expression 14]}$$

It is important to perform modeling, taking into consideration the possibilities of presence of all fundamental frequencies at the same time in this manner, since it is not possible to previously assume the number of sound sources for real-world audio signals carried through a CD or the like. If it is possible to estimate a model parameter $\theta^{(t)}$ such that the measured probability density function $p_\psi{}^{(t)}(x)$ of the frequency components is created from the model $p(x; \theta^{(t)})$, $p_\psi{}^{(t)}(x)$ can be regarded as being decomposed into individual tone models and a weight $w^{(t)})(F)$ for a tone model of fundamental frequency F can be interpreted as a probability density function $p_{FO}{}^{(t)}(F)$ of fundamental frequency F as shown in the following equation.

$$p_{F0}{}^{(t)}(F) = w^{(t)}(F)\ (Fli \leqq F \leqq Fhi) \quad \text{[Expression 15]}$$

That is, the more dominant a tone model p(x|F) is (i.e., the higher $w^{(t)}(F)$ is) in the mixed distribution, the higher the probability of the fundamental frequency F of the model is in $p_{FO}{}^{(t)}(F)$.

One can see from the above description that, when a probability density function $p_\psi{}^{(t)}(x)$ has been measured, we only need to solve the problem of estimating a parameter $\theta^{(t)}$ of the model $p(x; \theta^{(t)}$. The maximum-likelihood estimation of $\theta^{(t)}$ is obtained by maximizing an average log-likelihood defined as follows.

$$\int_{-\infty}^{+\infty} p_\psi{}^{(t)}(x) \log p(x;\theta^{(t)})dx \quad \text{[Expression 16]}$$

The parameter $\theta^{(t)}$ is estimated using the Expectation-Maximization (EM) algorithm described above since it is difficult to analytically solve the maximum-likelihood problem. The EM algorithm is an iterative algorithm that performs maximum-likelihood estimation from the incomplete measurement data ($p_\psi{}^{(t)}(x)$ in this case) by repeatedly applying an expectation (EM) step and a maximization (M) step alternately. In this embodiment, the most likely weight parameter $\theta^{(t)}(=\{w^{(t)}(F)|Fli \leqq F \leqq Fhi\})$ is obtained by repeating the EM algorithm under the assumption that the probability density function $p_\psi{}^{(t)}(x)$ of the frequency components that have passed through the BPF is a mixed distribution obtained by weighted mixture of a plurality of tone models p(x|F) corresponding respectively to a variety of fundamental frequencies F. Here, in each repetition of the EM algorithm, a new (more likely) estimated parameter $\theta_{new}{}^{(t)}(=\{w_{new}{}^{(t)}(F)|Fli \leqq F \leqq Fhi\})$ is obtained by updating an old estimated parameter $\theta_{old}{}^{(t)}(=\{w_{old}{}^{(t)}(F)|Fli \leqq F \leqq Fhi\})$. The final estimated value at time t−1 (one time ago) is used as an initial value of $\theta_{old}{}^{(t)}$. The following is a recurrence equation used to obtain the new estimated parameter $\theta_{new}(t)$ from the old estimated parameter $\theta_{old}(t)$. Details of how to derive this recurrence equation are described in Japanese Patent Registration No. 3413634. The details of how to derive this recurrence equation are also described in a paper entitled "A real-time music-scene-description system: predominant-F0 estimation for detecting melody and bass lines in real-world audio signals", Masataka Goto, Speech Communication 43 (2004) 311-329. All of the contents of this paper are incorporated into the specification by referencing.

$$w_{new}(F)^{(t)} = \int_{-\infty}^{+\infty} p_\Psi^{(t)}(x) \frac{w_{old}^{(t)}(F)p(x|F)}{\int_{Fli}^{Fhi} w_{old}^{(t)}(\eta)p(x|\eta)\,d\eta} dx \quad \text{[Expression 17]}$$

Figure 2:
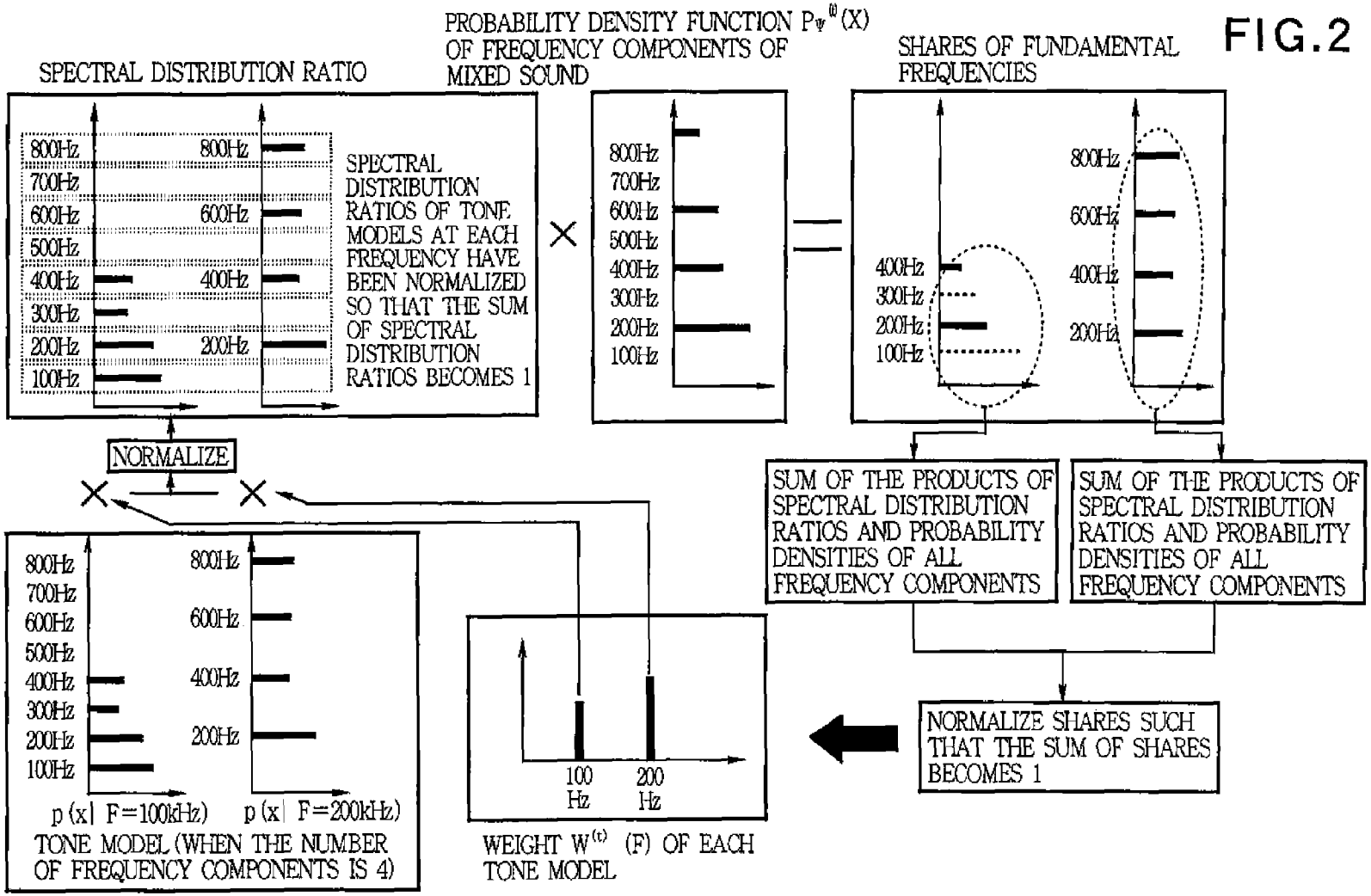
FIG. 2 illustrates how weight parameters of tone models are updated using an EM algorithm in the first embodiment.

FIG. 2 illustrates how the weight parameters $\theta^{(t)}(=\{w^{(t)}(F)|Fli \leqq F \leqq Fhi\})$ of tone models p(x|F) are updated using the EM algorithm in this embodiment. To simplify the illustration, FIG. 2 shows an example in which the number of frequency components of each tone model is 4.

In this embodiment, the EM algorithm obtains a spectral distribution ratio corresponding to each tone model p(x|F) at frequency x according to the following equation, based on the tone model p(x|F) of each fundamental frequency F and the current weight $w_{old}^{(t)}(F)$ of each tone model.

$$\text{spectral distribution ratio}(x \mid F) = \frac{w_{old}^{(t)}(F)\,p(x \mid F)}{\int_{Fli}^{Fhi} w_{old}^{(t)}(\eta)\,p(x \mid \eta)\,d\eta} \quad \text{[Expression 18]}$$

As shown in Expression 18, a spectral distribution ratio (x|F) corresponding to each tone model p(x|F) at a frequency x is obtained by calculating the sum of the amplitudes $w_{old}^{(t)}(F)p(x|F)$ of the tone models p(x|F) at the frequency x, multiplied by the weights $w_{old}^{(t)}(F)$, (where the sum corresponds to the integral in the denominator in Expression 18) and then dividing each amplitude $w_{old}^{(t)}(F)p(x|F)$ by the sum. As can be seen from Expression 18, the spectral distribution ratios (x|F) of the tone models p(x|F) at each frequency x have been normalized such that the sum of the spectral distribution ratios (x|F) is equal to 1.

In this embodiment, for each frequency x, a function value of the probability density function $p_{\psi}^{(t)}(x)$ at the frequency x is distributed according to the spectral distribution ratios of the tone models p(x|F) at the frequency x and the function values of the probability density function $p_{\psi}^{(t)}(x)$ distributed in this manner are summed for each tone model p(x|F) and the sum of the distributed function values of each tone model p(x|F) is determined to be the share (or portion) of the tone model p(x|F). Then, the shares of all tone models are summed and the share of each tone model is divided by the sum to normalize the shares of the tone models such that the sum of the shares is equal to 1. The normalized shares of the tone models p(x|F) are then determined to be their new weight parameters $w_{new}^{(t)}(F)$. Repeating the above procedure increasingly emphasizes the weight parameter $w^{(t)}(F)$ of a tone model p(x|F), which has a high probability based on the probability density function $p_{\psi}(t)(x)$ of the frequency components of the mixed sound, among the tone models p(x|F) with different fundamental frequencies. As a result, the weight parameter $w^{(t)}(F)$ represents the fundamental frequency probability density function of the mixed sound that has passed through the BPF.

<<Fundamental Frequency Determination 42>>

To determine the most dominant fundamental frequency Fi(t), we only need to obtain a frequency which maximizes the fundamental frequency probability density function $p_{FO}^{(t)}(F)$ (which is a final estimated value obtained through repeated calculations of the equation (17) according to the equation (15)) as shown in the following equation.

$$Fi(t) = \underset{F}{\operatorname{argmax}}\, p_{F0}^{(t)}(F) \quad \text{[Expression 19]}$$

The frequency obtained in this manner is determined to be the pitch.

<<Improvement of This Embodiment over Technology of Japanese Patent Registration No. 3413634>>

The fundamental frequency probability density function obtained through the EM algorithm in the fundamental frequency probability density function estimation 41 described above has a plurality of salient peaks. These peaks include not only peaks corresponding to fundamental frequencies of sounds that have been actually played but also peaks created as corresponding probability densities have been erroneously raised although any sounds have not actually been played. In the following description, the erroneously created peaks are referred to as ghosts.

In the technology of Japanese Patent Registration No. 3413634, successive tracking of fundamental frequencies is performed according to the multi-agent model in order to obtain fundamental frequencies of sounds, which have been actually played, from among fundamental frequencies with probability densities peaked in the probability density function gradually obtained through the EM algorithm in a situation where ghosts may occur.

On the contrary, this embodiment does not perform successive tracking of fundamental frequencies according to the multi-agent model. Instead, this embodiment provides the sound analysis program with previous knowledge about a sound source that has generated the input audio signal. When repeating the E and M steps of the EM algorithm using the fundamental frequency probability density function obtained by performing the E and M steps as shown in FIG. 2, the sound analysis program controls the probability density function using the previous knowledge. Repeating the control of the probability density function gradually changes the probability density function obtained by performing the E and M steps to a probability density function that emphasizes only the prominent peaks of probability densities corresponding to the fundamental frequencies of sounds that are likely to have been actually played.

More specifically, in the fundamental frequency probability density function estimation 41, the sound analysis program according to this embodiment repeats E and M steps 411 of the EM algorithm, convergence determination 412, form estimation 413, which is a process using "previous knowledge" as described above, and previous distribution imparting 414 as shown in FIG. 1.

First, in the E and M steps 411, the sound analysis program obtains a fundamental frequency probability density function (i.e., weights $\theta=\theta_{new}^{(t)}(=\{w_{new}^{(t)}(F)|Fli \leqq F \leqq Fhi\})$ of tone models corresponding to a variety of fundamental frequencies F) according to the recurrence equation of Expression 17 described above.

Next, in the convergence determination 412, the sound analysis program compares the weights $\theta=\theta_{new}^{(t)}$ of the tone models corresponding to the variety of fundamental frequencies F obtained in the current E and M steps 411 with the previous weights $\theta=\theta_{old}^{(t)}$ and determines whether or not the change in the weights θ is within an allowable range. If it is determined that the change in the weights θ is within the allowable range, the sound analysis program terminates the process of the fundamental frequency probability density function estimation 41 and proceeds to the fundamental frequency determination 42. On the other hand, if it is determined that the change in the weights θ is not within the allowable range, the sound analysis program proceeds to the form estimation 413.

In the form estimation 413, the sound analysis program obtains the fundamental frequencies F of sounds that are estimated to be likely to have been actually played from among the fundamental frequencies F, each of which has a peaked probability density in the probability density function obtained in the E and M steps 411. In this embodiment, when performing this form estimation 413, the sound analysis program refers to sound source structure data 413F previously stored in memory of the sound analysis apparatus. This sound source structure data 413F is data regarding the structure of a sound source that has generated the input audio signal. The sound source structure data 413F includes data defining sounds that can be generated by the sound source and data defining constraints on sounds that can be simultaneously generated by the sound source. In this example, the sound source is a guitar having 6 strings. Thus, for example, the sound source structure data 413F has the following contents.

<<Contents of Sound Source Structure Data 413F>>>

(1) Data Defining Sounds that can be Generated by Sound Source

When the sound source is a guitar, a sound generated by plucking a string is determined by both the string number of the string and the fret position of the string pressed on the fingerboard. When the string number ks is 1-6 and the fret number kf is 0-N (where "0" corresponds to an open string that is not fretted by any finger), the guitar can generate 6×(N+1) types of sounds (which include sounds with the same fundamental frequency) corresponding to combinations of the string number ks and the fret number kf. The sound source structure data includes data that defines the respective fundamental frequencies of sounds generated by strings in association with the corresponding combinations of the string number ks and the fret number kf.

(2) Data Defining Constraints on Sounds that can be Simultaneously Generated by Sound Source Constraint "a": The number of sounds that can be generated simultaneously The maximum number of sounds that can be generated at the same time is 6 since the number of strings is 6.

Constraint "b": Constraint on combinations of fret positions that can be pressed. Two frets, the fret numbers of which are farther away from each other than some limit, cannot be pressed at the same time by any fingers due to the limitation of the length of the human fingers. The upper limit of the difference between the largest and smallest of a plurality of frets that can be pressed at the same time is defined in the sound source structure data 413F.

Constraint "c": The number of sounds that can be generated per string.

The number of sounds that can be simultaneously generated with one string is 1.

Figure 3:
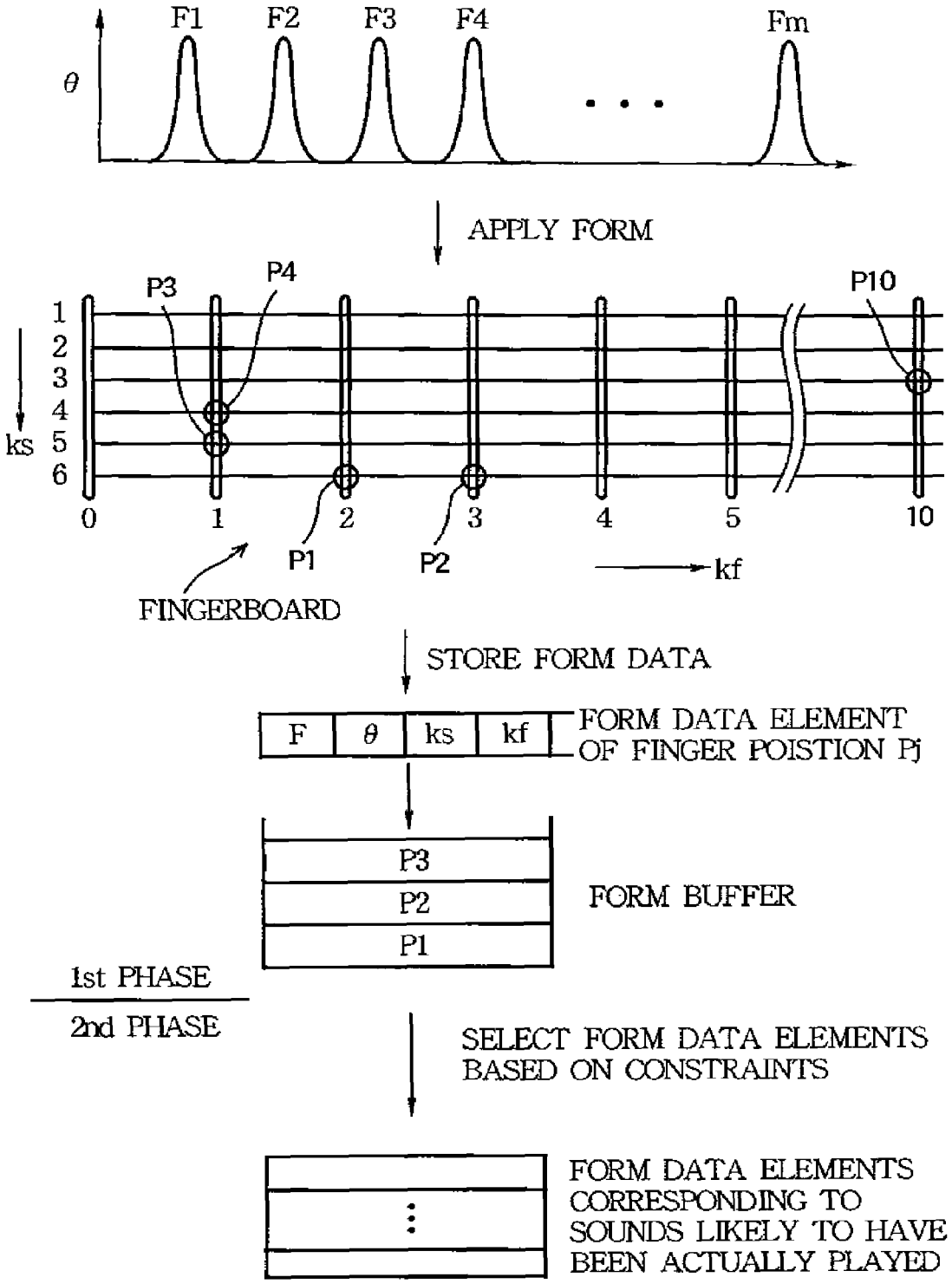
FIG. 3 illustrates a process of form estimation performed in the first embodiment.

FIG. 3 illustrates the process of the form estimation 413. As shown, the form estimation 413 has a first phase ("apply form" phase) and a second phase ("select form" phase).

In the first phase, the sound analysis program refers to "data defining sounds that can be generated by sound source" in the sound source structure data 413F. The sound analysis program then obtains finger positions P1, P2, . . . at which the finger is to be placed on the fingerboard of a guitar, which is the sound source, in order to generate respective sounds of the fundamental frequencies F=F1, F2, . . . , each of which has a peaked probability density in the probability density function obtained in the E and M steps 411. For each finger position obtained in this manner, the sound analysis program then creates form data including a fundamental frequency F, which is the primary component, a probability density (weight θ) corresponding to the fundamental frequency F in the probability density function, and a string number ks and a fret number kf specifying the finger position and stores the form data in a form buffer. Here, a plurality of finger positions may generate sounds of the same fundamental frequency F. In this case, the sound analysis program creates a plurality of form data elements corresponding respectively to the plurality of finger positions, each of which includes a fundamental frequency F, a weight θ, a string number ks, and a fret number kf, and stores the plurality of form data elements in the form buffer.

In the second phase of the form estimation 413, the sound analysis program selects a number of form data elements corresponding to different fundamental frequencies F, which satisfies the constraint "a," from the form data stored in the form buffer. Here, the sound analysis program selects the form data elements such that the relationship of each selected form data element with another selected form data element does not violate the constraints "b" and "c."

In the example shown in FIG. 3, leaving two form data elements corresponding to the finger positions P1 and P2 in the selected form data elements violates the constraint "c" since the finger positions P1 and P2 are on the same string. Accordingly, the sound analysis program selects a form data element corresponding to one of the finger positions P1 and P2 (for example, P1). A variety of methods can be employed to select which one of a plurality of form data elements that are mutually exclusive under the constraint "c." In one preferred embodiment, one of the plurality of form data elements corresponding to the lowest fundamental frequency F is selected and the other form data elements are excluded. In another preferred embodiment, one of the form data elements having the highest weight θ is selected and the other form data elements are excluded.

The finger positions in the example shown in FIG. 3 does not satisfy the constraint "b" since the finger positions are distributed over the range of fret positions of fret numbers kf=1-10 and there is too large a gap between the fret of fret number kf=1 and the fret of fret number kf=10. In this example, the finger positions P1-P4 with the lower fret numbers are the majority and the finger position P10 with the fret number kf=10 is the minority. Accordingly, the form data element corresponding to the finger position P10 is excluded in the second phase.

In this manner, the sound analysis program keeps excluding form data elements, which are obstacles to satisfying the constraints "b" and "c", among the form data elements in the form buffer in the second phase. If 6 or less form data elements are left after the exclusion, the sound analysis program determines these form data elements to be those corresponding to sounds that are likely to have been actually played. If 7 or more form data elements are left so that the constraint "a" is not satisfied, the sound analysis program selects 6 or less form data elements, for example using a method in which it excludes a form data element with the lower or lowest weight θ, and then determines the selected form data elements to be those corresponding to sounds that are likely to have been actually played.

Figure 4:
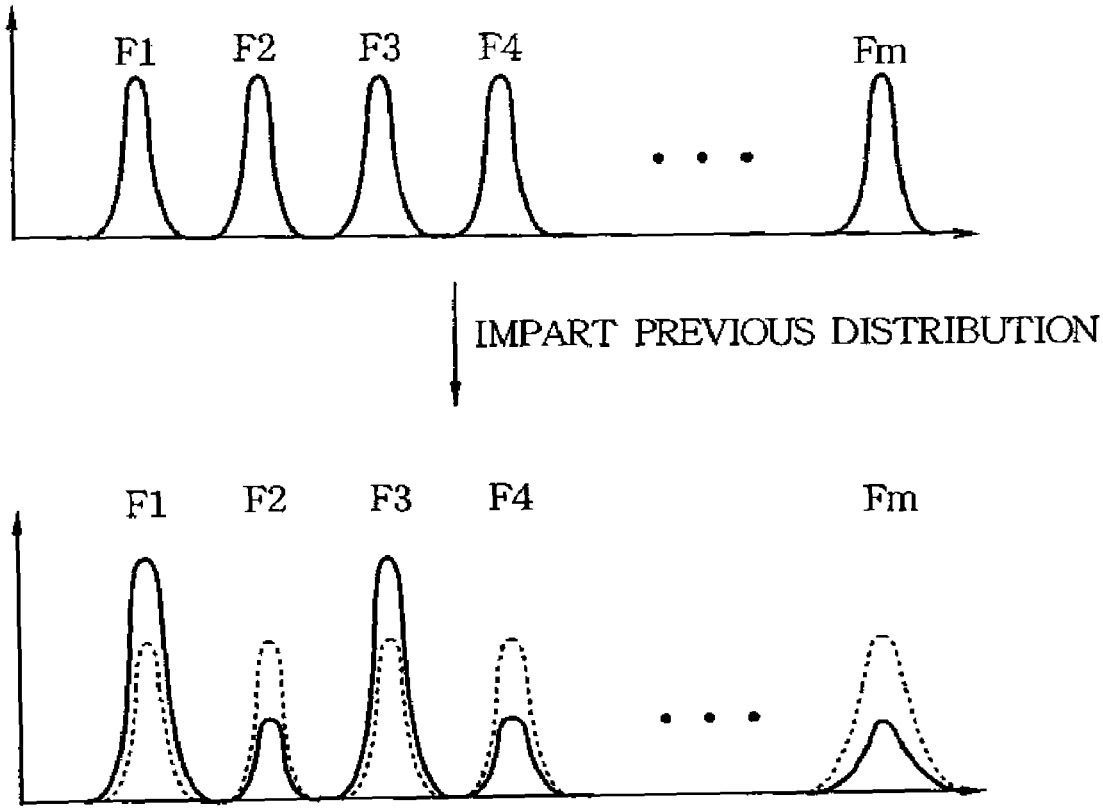
FIG. 4 illustrates a process of previous distribution imparting performed in the first embodiment.

In the previous distribution imparting 414, the sound analysis program controls the probability density function of fundamental frequencies F obtained through the E and M steps 411, using the form data elements corresponding to sounds likely to have been actually played, which have been obtained in the form estimation 413. FIG. 4 illustrates a process of this previous distribution imparting 414. As shown in FIG. 4, in the previous distribution imparting 414, the sound analysis program increases the salient peaks of probability densities (weights) corresponding to fundamental frequencies F (F1 and F3 in the illustrated example) represented by the form data elements corresponding to sounds likely to have been actually played, among the peaks of probability densities in the probability density function of fundamental frequencies F obtained through the E and M steps 411, and decreases the other peaks (F2, F4, and Fm in the illustrated example). The sound analysis program then transfers the probability density function of fundamental frequencies F, to which a distribution has been previously imparted in this manner, to the next E and M steps 411.

Repeating the above procedure gradually changes the probability density function obtained by performing the E and M steps 411 to a probability density function that emphasizes only the salient peaks of probability densities corresponding to the fundamental frequencies of sounds likely to have been actually played. If the change in the probability densities (=weights θ) throughout the E and M steps 411 is within an allowable range, the sound analysis program stops repeating the E and M steps 411 in the convergence determination 412 and transfers the probability density function of fundamental frequencies to the fundamental frequency determination 42.

In the fundamental frequency determination 42 in this embodiment, first, the sound analysis program obtains peak values of the probability densities corresponding to the fundamental frequencies represented by the form data elements obtained in the form estimation 413 from the probability density function obtained through the fundamental frequency probability density function estimation 41. The sound analysis program then obtains the maximum value of the obtained peak values of the probability densities and obtains a threshold TH by multiplying the maximum value by a predetermined factor prior_thres. The sound analysis program then selects fundamental frequencies, each of which has a probability density peak value higher than the threshold TH, from the fundamental frequencies represented by the form data elements and determines the selected fundamental frequencies to be those of played sounds. The following is why the fundamental frequencies of played sounds are selected through these processes.

First, the integral of the probability density function over a range of all frequencies is 1. Thus, the maximum probability density peak value is high if the number of actually played sounds is small and is low if the number of actually played sounds is large. Accordingly, in this embodiment, when it is determined whether or not each peak appearing in the probability density function is that of an actually played sound, the threshold TH for use in comparison with each probability density peak value is associated with the maximum probability density peak value so that the fundamental frequencies of actually played sounds are appropriately selected.

Figure 5:
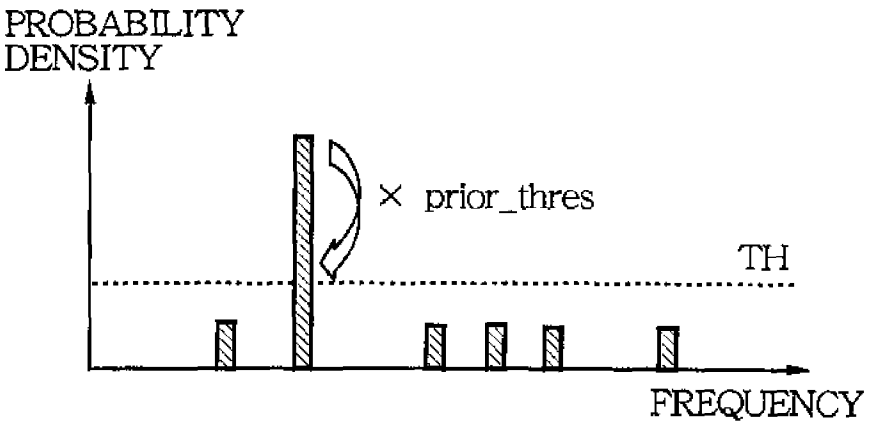
FIGS. 5(*a*) and 5(*b*) illustrate examples of fundamental frequency determination performed in the first embodiment.
Figure 5:
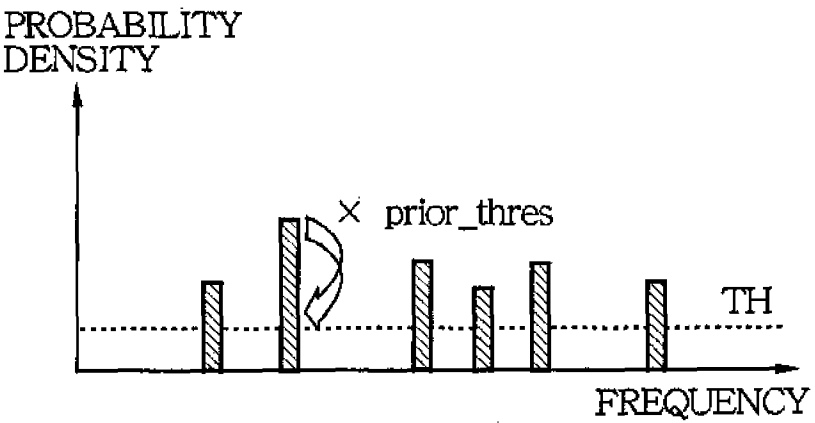

FIGS. 5(*a*) and 5(*b*) illustrate examples of the fundamental frequency determination 42 according to this embodiment. First, the number of played sounds is large in the example shown in FIG. 5(*a*). Therefore, the peak values of probability densities of fundamental frequencies are low on average and the variance of the peak values is low. In this case, the threshold TH is also low since the maximum peak value is low. Accordingly, the peak values (6 peak values shown in FIG. 5(*a*)) of all the fundamental frequencies selected through the form estimation exceed the threshold TH and these fundamental frequencies are determined to be those of played sounds. On the other hand, the number of played sounds is small in the example shown in FIG. 5(*b*). Therefore, the peak values of probability densities of actually played sounds appearing in the probability density function are high and the peak values of probability densities of other sounds are low and there is a very great difference between the peak values of the played sounds and those of the other sounds. In this case, when a threshold TH is determined based on the maximum peak value, a relatively small number of ones (one peak value in the example shown in FIG. 5(*b*)) of the peak values of the fundamental frequencies selected through the form estimation exceed the threshold TH and the corresponding fundamental frequencies are determined to be those of played sounds.

The above description is of details of this embodiment.

As described above, this embodiment estimates a fundamental frequency probability density function of an input audio signal using an EM algorithm and uses previous knowledge specific to a musical instrument to obtain the fundamental frequencies of sounds generated by the musical instrument. This allows accurate estimation of the fundamental frequencies of sounds generated by the musical instrument.

Second Embodiment

Figure 6:
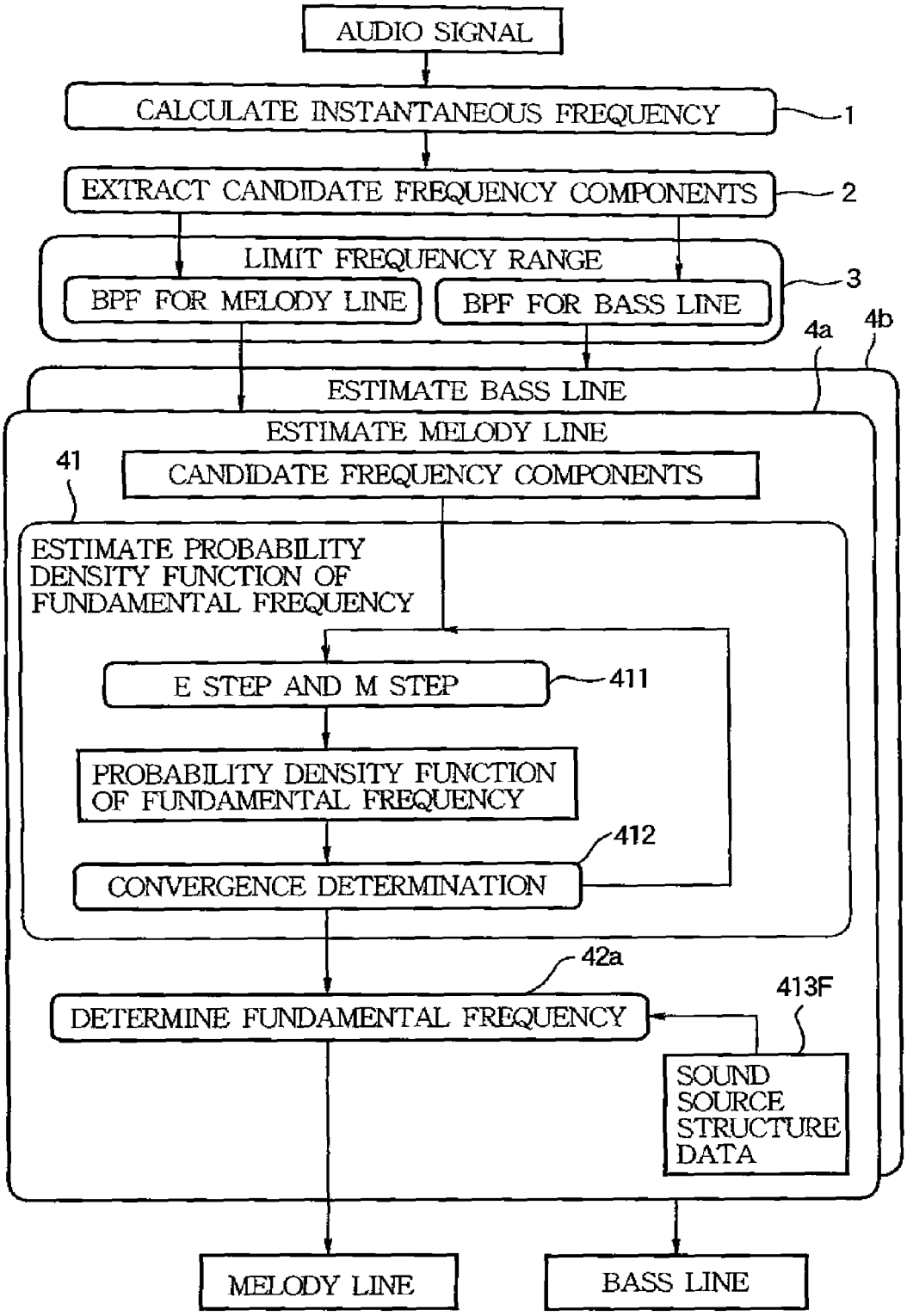
FIG. 6 illustrates processes of a sound analysis program according to a second embodiment of the present invention.

FIG. 6 illustrates processes of a sound analysis program according to the second embodiment of the present invention. In the fundamental frequency probability density function estimation 41 in the first embodiment, the sound analysis program performs the form estimation 413 and the previous distribution imparting 414 each time the E and M steps 411 are repeated. On the contrary, in fundamental frequency probability density function estimation 41 in this embodiment, the sound analysis program repeats E and M steps 411 and convergence determination 412 alone. In addition, in fundamental frequency determination 42*a* in this embodiment, the sound analysis program performs, as a previous process to determining the fundamental frequencies, the same process as that of the form estimation 413 of the first embodiment on the probability density function of fundamental frequencies F to obtain the fundamental frequencies of sounds likely to have been played. The sound analysis program then performs the same process as that of the fundamental frequency determination 42 of the first embodiment to select one or a plurality of fundamental frequencies from the obtained fundamental frequencies of sounds likely to have been played and to determine the selected fundamental frequencies as those of sounds likely to have been played.

This embodiment has the same advantages as that of the first embodiment. This embodiment also reduces the amount of computation when compared to the first embodiment since the number of times the form estimation 413 is performed is reduced and the previous distribution imparting 414 is not performed.

Third Embodiment

Figure 7:
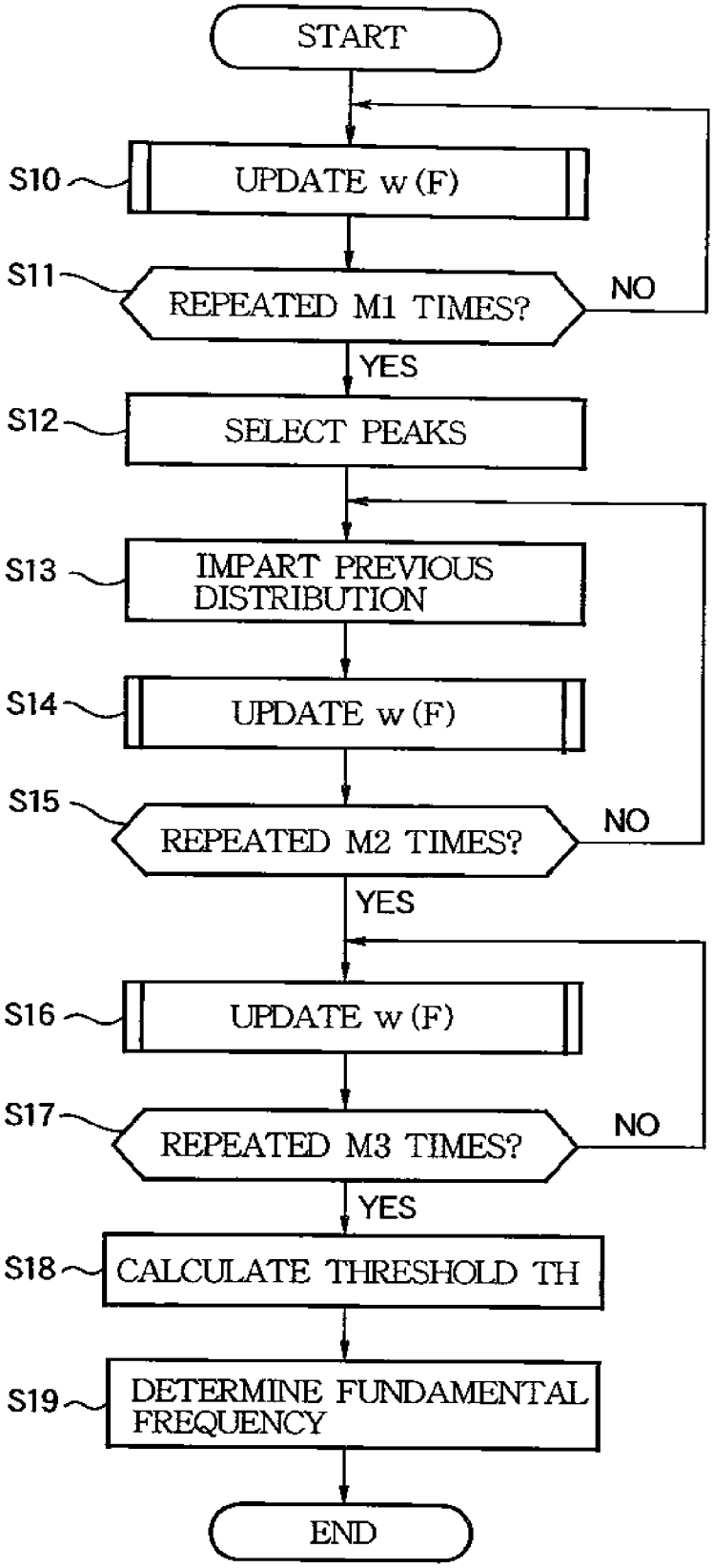
FIG. 7 is a flow chart showing processes, corresponding to fundamental frequency probability density function estimation and fundamental frequency determination, among processes of a sound analysis program according to a third embodiment of the present invention.

FIG. 7 is a flow chart showing processes, corresponding to the fundamental frequency probability density function estimation 41 and the fundamental frequency determination 42 of the first embodiment, among the processes of a sound analysis program according to the third embodiment of the present invention. In this embodiment, the sound analysis program performs the processes shown in FIG. 7 each time a probability density function $p_{\psi}^{(t)}(x)$ of a mixed sound of one frame is obtained.

(1) First, the sound analysis program performs a process corresponding to first update means. More specifically, the sound analysis program repeats the E and M steps of the first embodiment M1 times (M1: an integer greater than 1) based on the probability density function $p_{\psi}^{(t)}(x)$, without imparting previous distribution, and updates the weight $\theta=w^{(t)}(F)$ of a tone model corresponding to each fundamental frequency F (steps S10 and S11).

(2) The sound analysis program then performs a process corresponding to fundamental frequency selection means. More specifically, the sound analysis program performs a peak selection process (step S12) corresponding to the form estimation 413 of the first embodiment and stores the one or more fundamental frequencies of one or more sounds likely to have been played in the memory.

(3) The sound analysis program then performs a process corresponding to second update means. More specifically, the sound analysis program repeats a process (step S13) of imparting previous distribution to the probability density function to emphasize probability densities of the one or more fundamental frequencies stored in the memory and a process (step S14) of performing E and M steps to update the weights $\theta=w^{(t)}(F)$ of the tone models corresponding to the fundamental frequencies F M2 times (M2: an integer greater than 1) (step S15).

(4) The sound analysis program then performs a process corresponding to third update means. More specifically, the sound analysis program repeats E and M steps M3 times (M3: an integer greater than 1) without imparting the previous distribution and updates the weights $\theta=w^{(t)}(F)$ of the tone models corresponding to the fundamental frequencies F (steps S16 and S17). The purpose of performing the processes of steps S16 and S17 is to attenuate the peaks of probability densities of fundamental frequencies of sounds that have not actually been played, which may be included in the peaks of probability densities emphasized by repeating steps S13 to S15. The process corresponding to the third update means may be omitted if the peaks of probability densities of fundamental frequencies of sounds that have not actually been played are unlikely to be emphasized in the process corresponding to the second update means.

(5) The sound analysis program then performs a process for determining fundamental frequencies. More specifically, according to the same method as that of the first embodiment, the sound analysis program calculates a threshold TH for peak values of probability densities corresponding to the fundamental frequencies stored in the memory (step S18) and determines fundamental frequencies using the threshold TH (step S19), thereby determining the fundamental frequencies of sounds that have been actually played.

In this embodiment, the process of step S12 corresponding to the form estimation 413 can be shared by both the fundamental frequency probability density function estimation and the fundamental frequency determination so that the process can be completed only once (i.e., without repetition). In addition, in this embodiment, EM estimation without imparting the previous distribution is additionally performed a specific number of times (steps S16 and S17) after EM estimation with previous distribution imparting using the result of the form estimation of step S12 is performed a specific number of times (steps S13-S15). Accordingly, for example, even if the probability densities of the 6 fundamental frequencies of 6 sounds, which are the maximum number of sounds that can be generated, have been emphasized through the processes of steps S13 to S15 although a smaller number of sounds have been played, the erroneously emphasized probability densities are expected to converge to the correct solution through the subsequent EM estimation (steps S16 and S17). Thus, this embodiment can determine the fundamental frequencies of sounds that have been played with higher efficiency than the first and second embodiments.

Other Embodiments

Although the first to third embodiments of the present invention have been described, other embodiments can be provided according to the present invention. The following are examples.

(1) In the form estimation 413 of each of the above embodiments, the following control may be added to improve the refinement of form data elements of sounds that are likely to have been actually played. A weight θ corresponding to a fundamental frequency F in a probability density function, represented by each form data element selected based on the constraints, is forcibly set to zero and the E and M steps 411 are performed once. If the change in the probability density function throughout the E and M steps 411 is not great, a peak of the weight θ created at the fundamental frequency F is likely to be a ghost. Accordingly, the form data element corresponding to this fundamental frequency F is excluded from the form data elements of sounds that are likely to have been actually played. Performing this process on each form data element selected based on the constraints can improve the refinement of the form data elements of sounds that are likely to have been actually played to obtain form data elements excluding ones corresponding to ghosts.

(2) In the first embodiment, the constraint "a" may not be imposed when performing the second phase (form selection phase) of the form estimation 413 to leave form data elements corresponding to as many sounds as possible at a stage where the change in the fundamental frequency probability density function is great shortly after the fundamental frequency probability density estimation 41 of a certain moment is initiated and the constraint "a" may be imposed when performing the second phase (form selection phase) of the form estimation 413 at a stage where the fundamental frequency probability density function has converged to some extent so that the change is not great.

Figure 8:
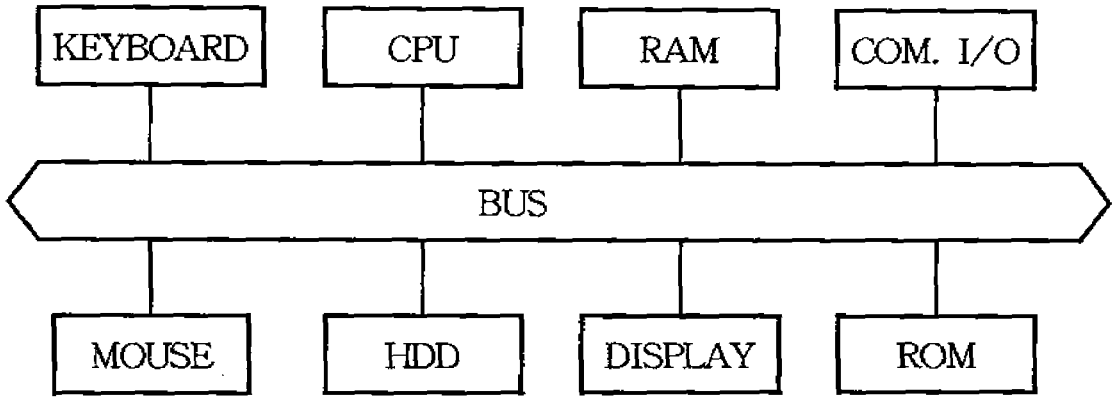
FIG. 8 is a block diagram showing a hardware construction of the sound analysis apparatus in the form of a personal computer.

FIG. 8 is a block diagram showing a hardware structure of the sound analysis apparatus constructed according to the invention. The inventive sound analysis apparatus is based on a personal computer composed of CPU, RAM, ROM, HDD (Hard Disk Drive), Keyboard, Mouse, Display and COM I/O (communication input/output interface).

A sound analysis program is installed and executed on the personal computer that has audio signal acquisition functions such as a communication function to acquire musical audio signals from a network through COM I/O. Otherwise, the personal computer may be equipped with a sound collection function to obtain input audio signals from nature, or a player function to reproduce musical audio signals from a recording medium such as HDD or CD. The computer, which executes the sound analysis program according to this embodiment, functions as a sound analysis apparatus according to the invention.

A machine readable medium such as HDD or ROM is provided in the personal computer having a processor (namely, CPU) for analyzing an input audio signal based on a weighted mixture of a plurality of tone models which represent harmonic structures of sound sources and which correspond to probability density functions of various fundamental frequencies. The machine readable medium contains program instructions executable by the processor for causing the sound synthesis apparatus to perform a probability density estimation process of sequentially updating and optimizing respective weights of the plurality of the tone models, so that a mixed distribution of frequencies obtained by the weighted mixture of the plurality of the tone models corresponding respectively to the various fundamental frequencies approximates an actual distribution of frequency components of the input audio signal, and estimating the optimized weights of the tone models to be a fundamental frequency probability density function of the various fundamental frequencies corresponding to the sound sources, and a fundamental frequency determination process of determining an actual fundamental frequency of the input audio signal based on the fundamental frequency probability density function estimated by the probability density estimation process.

In the first embodiment, the probability density estimation process comprises a storage process of storing sound source structure data defining a constraint on one or more of sounds that can be simultaneously generated by a sound source of the input audio signal, a form estimation process of selecting fundamental frequencies of one or more of sounds likely to be contained in the input audio signal with peaked weights from the various fundamental frequencies during the sequential updating and optimizing of the weights of the tone models corresponding to the various fundamental frequencies, so that the sounds of the selected fundamental frequencies satisfy the sound source structure data, and creating form data specifying the selected fundamental frequencies, and a previous distribution impart process of imparting a previous distribution to the weights of the tone models corresponding to the various fundamental frequencies so as to emphasize weights corresponding to the fundamental frequencies specified by the form data created by the form estimation process.

In the second embodiment, the fundamental frequency determination process comprises a storage process of storing sound source structure data defining a constraint on one or more of sounds that can be simultaneously generated by a sound source of the input audio signal, a form estimation process of selecting, from the various fundamental frequencies, fundamental frequencies of one or more of sounds which have weights peaked in the fundamental frequency probability density function estimated by the probability density estimation process and which are estimated to be likely contained in the input audio signal so that the selected fundamental frequencies satisfy the constraint defined by the sound source structure data, and creating form data representing the selected fundamental frequencies, and a determination process of determining the actual fundamental frequency of the input audio signal based on the form data.

In the third embodiment, the probability density estimation process comprises a storage process that stores sound source structure data defining a constraint on one or more of sounds that can be simultaneously generated by a sound source of the input audio signal, a first update process of updating the weights of the tone models corresponding to the various fundamental frequencies a specific number of times for approximating the frequency components of the input audio signal, a fundamental frequency selection process of obtaining fundamental frequencies with peaked weights based on the weights updated by the first update process from the various fundamental frequencies and that selects fundamental frequencies of one or ore more sounds likely to be contained in the input audio signal from the obtained fundamental frequencies with the peaked weights so that the selected fundamental frequencies satisfy the constraint defined by the sound source structure data, and a second update process of imparting a previous distribution to the weights of the tone models corresponding to the various fundamental frequencies so as to emphasize the weights corresponding to the fundamental frequencies selected by the fundamental frequency selection process, and updating the weights of the tone models corresponding to the various fundamental frequencies a specific number of times for further approximating the frequency components of the input audio signal.

What is claimed is:

1. A sound analysis apparatus for analyzing an input audio signal based on a weighted mixture of a plurality of tone models which represent harmonic structures of sound sources and which correspond to probability density functions of various fundamental frequencies, the apparatus comprising:

a probability density estimation part that sequentially updates and optimizes respective weights of the plurality of the tone models, so that a mixed distribution of frequencies obtained by the weighted mixture of the plurality of the tone models corresponding respectively to the various fundamental frequencies approximates an actual distribution of frequency components of the input audio signal, and that estimates the optimized weights of the tone models to be a fundamental frequency probability density function of the various fundamental frequencies corresponding to the sound sources; and a fundamental frequency determination part that determines an actual fundamental frequency of the input audio signal based on the fundamental frequency probability density function estimated by the probability density estimation part, wherein the probability density estimation part comprises:

a storage part that stores sound source structure data defining a constraint on one or more of sounds that can be simultaneously generated by a sound source of the input audio signal, a form estimation part that selects fundamental frequencies of one or more of sounds likely to be contained in the input audio signal with peaked weights from the various fundamental frequencies during the sequential updating and optimizing of the weights of the tone models corresponding to the various fundamental frequencies, so that the sounds of the selected fundamental frequencies satisfy the sound source structure data, and that creates form data specifying the selected fundamental frequencies, and a previous distribution imparting part that imparts a previous distribution to the weights of the tone models corresponding to the various fundamental frequencies so as to emphasize weights corresponding to the fundamental frequencies specified by the form data created by the form estimation part.

2. The sound analysis apparatus according to claim 1, wherein the fundamental frequency determination part includes a part for calculating a threshold value according to a maximum one of respective peak values of probability densities which are provided by the fundamental frequency probability density function and which correspond to the fundamental frequencies specified by the form data, selecting a fundamental frequency with a probability density whose peak value is greater than the threshold value from the fundamental frequencies specified by the form data, and determining the selected fundamental frequency to be the actual fundamental frequency of the input audio signal.

3. The sound analysis apparatus according to claim 1, wherein the probability density estimation part further includes a part for selecting each fundamental frequency specified by the form data, setting a weight corresponding to the selected fundamental frequency to zero, performing a process of updating the weights of the tone models corresponding to the various fundamental frequencies once, and excluding the selected fundamental frequency from the fundamental frequencies of the sounds that are estimated to be likely to be contained in the input audio signal if the updating process makes no great change in the weights of the tone models corresponding to the various fundamental frequencies.

4. A sound analysis apparatus for analyzing an input audio signal based on a weighted mixture of a plurality of tone models which represent harmonic structures of sound sources and which correspond to probability density functions of various fundamental frequencies, the apparatus comprising:

a probability density estimation part that sequentially updates and optimizes respective weights of the plurality of the tone models, so that a mixed distribution of frequencies obtained by the weighted mixture of the plurality of the tone models corresponding respectively to the various fundamental frequencies approximates a distribution of frequency components of the input audio signal, and that estimates the optimized weights of the tone models to be a fundamental frequency probability density function of the various fundamental frequencies corresponding to the sound sources; and a fundamental frequency determination part that determines an actual fundamental frequency of the input audio signal based on the fundamental frequency probability density function estimated by the probability density estimation part, wherein the fundamental frequency determination part comprises:

a storage part that stores sound source structure data defining a constraint on one or more of sounds that can be simultaneously generated by a sound source of the input audio signal, a form estimation part that selects, from the various fundamental frequencies, fundamental frequencies of one or more of sounds which have weights peaked in the fundamental frequency probability density function estimated by the probability density estimation part and which are estimated to be likely contained in the input audio signal so that the selected fundamental frequencies satisfy the constraint defined by the sound source structure data, and that creates form data representing the selected fundamental frequencies, and a determination part that determines the actual fundamental frequency of the input audio signal based on the form data.

5. The sound analysis apparatus according to claim 4, wherein the fundamental frequency determination part includes a part for calculating a threshold value according to a maximum one of respective peak values of probability densities which are provided by the fundamental frequency probability density function and which correspond to the fundamental frequencies specified by the form data, selecting a fundamental frequency with a probability density whose peak value is greater than the threshold value from the fundamental frequencies specified by the form data, and determining the selected fundamental frequency to be the actual fundamental frequency of the input audio signal.

6. The sound analysis apparatus according to claim 4, wherein the probability density estimation part includes a part for selecting each fundamental frequency specified by the form data, setting a weight corresponding to the selected fundamental frequency to zero, performing a process of updating the weights of the tone models corresponding to the various fundamental frequencies once, and excluding the selected fundamental frequency from the fundamental frequencies of the sounds that are estimated to be likely to be contained in the input audio signal if the updating process makes no great change in the weights of the tone models corresponding to the various fundamental frequencies.

7. A sound analysis apparatus for analyzing an input audio signal based on a weighted mixture of a plurality of tone models which represent harmonic structures of sound sources and which correspond to probability density functions of various fundamental frequencies, the apparatus comprising:

a probability density estimation part that sequentially updates and optimizes respective weights of the plurality of the tone models, so that a mixed distribution of frequencies obtained by the weighted mixture of the plurality of the tone models corresponding to the various fundamental frequencies approximates a distribution of frequency components of the input audio signal, and that estimates the optimized weights of the tone models to be a fundamental frequency probability density function of the various fundamental frequencies corresponding to the sound sources; and a fundamental frequency determination part that determines an actual fundamental frequency of the input audio signal based on the fundamental frequency probability density function estimated by the probability density estimation part, wherein the probability density estimation part comprises:

a storage part that stores sound source structure data defining a constraint on one or more of sounds that can be simultaneously generated by a sound source of the input audio signal, a first update part that updates the weights of the tone models corresponding to the various fundamental frequencies a specific number of times for approximating the frequency components of the input audio signal, a fundamental frequency selection part that obtains fundamental frequencies with peaked weights based on the weights updated by the first update part from the various fundamental frequencies and that selects fundamental frequencies of one more sounds likely to be contained in the input audio signal from the obtained fundamental frequencies with the peaked weights so that the selected fundamental frequencies satisfy the constraint defined by the sound source structure data, and a second update part that imparts a previous distribution to the weights of the tone models corresponding to the various fundamental frequencies so as to emphasize the weights corresponding to the fundamental frequencies selected by the fundamental frequency selection part, and that updates the weights of the tone models corresponding to the various fundamental frequencies a specific number of times for further approximating the frequency components of the input audio signal.

8. The sound analysis apparatus according to claim 7, wherein the probability density estimation part further includes a third update part that updates the weights, updated by the second update part, of the tone models corresponding to the various fundamental frequencies a specific number of times for further approximating the frequency components of the input audio signal, without imparting the previous distribution.

9. The sound analysis apparatus according to claim 7, wherein the fundamental frequency determination part includes a part for calculating a threshold value according to a maximum one of respective peak values of probability densities which are provided by the fundamental frequency probability density function and which correspond to the fundamental frequencies specified by the form data, selecting a fundamental frequency with a probability density whose peak value is greater than the threshold value from the fundamental frequencies specified by the form data, and determining the selected fundamental frequency to be the actual fundamental frequency of the input audio signal.

10. The sound analysis apparatus according to claim 7, wherein the probability density estimation part further includes a part for selecting each fundamental frequency specified by the form data, setting a weight corresponding to the selected fundamental frequency to zero, performing a process of updating the weights of the tone models corresponding to the various fundamental frequencies once, and excluding the selected fundamental frequency from the fundamental frequencies of the sounds that are estimated to be likely to be contained in the input audio signal if the updating process makes no great change in the weights of the tone models corresponding to the various fundamental frequencies.

11. A machine readable medium for use in a sound analysis apparatus having a processor for analyzing an input audio signal based on a weighted mixture of a plurality of tone models which represent harmonic structures of sound sources and which correspond to probability density functions of various fundamental frequencies, the machine readable medium containing program instructions executable by the processor for causing the sound synthesis apparatus to perform:

a probability density estimation process of sequentially updating and optimizing respective weights of the plurality of the tone models, so that a mixed distribution of frequencies obtained by the weighted mixture of the plurality of the tone models corresponding respectively to the various fundamental frequencies approximates an actual distribution of frequency components of the input audio signal, and estimating the optimized weights of the tone models to be a fundamental frequency probability density function of the various fundamental frequencies corresponding to the sound sources; and a fundamental frequency determination process of determining an actual fundamental frequency of the input audio signal based on the fundamental frequency probability density function estimated by the probability density estimation process, wherein the probability density estimation process comprises:

a storage process of storing sound source structure data defining a constraint on one or more of sounds that can be simultaneously generated by a sound source of the input audio signal, a form estimation process of selecting fundamental frequencies of one or more of sounds likely to be contained in the input audio signal with peaked weights from the various fundamental frequencies during the sequential updating and optimizing of the weights of the tone models corresponding to the various fundamental frequencies, so that the sounds of the selected fundamental frequencies satisfy the sound source structure data, and creating form data specifying the selected fundamental frequencies, and a previous distribution impart process of imparting a previous distribution to the weights of the tone models corresponding to the various fundamental frequencies so as to emphasize weights corresponding to the fundamental frequencies specified by the form data created by the form estimation process.

12. A machine readable medium for use in a sound analysis apparatus having a processor for analyzing an input audio signal based on a weighted mixture of a plurality of tone models which represent harmonic structures of sound sources and which correspond to probability density functions of various fundamental frequencies, the machine readable medium containing program instructions executable by the processor for causing the sound synthesis apparatus to perform:

a probability density estimation process of sequentially updating and optimizing respective weights of the plurality of the tone models, so that a mixed distribution of frequencies obtained by the weighted mixture of the plurality of the tone models corresponding respectively to the various fundamental frequencies approximates a distribution of frequency components of the input audio signal, and estimating the optimized weights of the tone models to be a fundamental frequency probability density function of the various fundamental frequencies corresponding to the sound sources; and a fundamental frequency determination process of determining an actual fundamental frequency of the input audio signal based on the fundamental frequency probability density function estimated by the probability density estimation process, wherein the fundamental frequency determination process comprises:

a storage process of storing sound source structure data defining a constraint on one or more of sounds that can be simultaneously generated by a sound source of the input audio signal, a form estimation process of selecting, from the various fundamental frequencies, fundamental frequencies of one or more of sounds which have weights peaked in the fundamental frequency probability density function estimated by the probability density estimation process and which are estimated to be likely contained in the input audio signal so that the selected fundamental frequencies satisfy the constraint defined by the sound source structure data, and creating form data representing the selected fundamental frequencies, and a determination process of determining the actual fundamental frequency of the input audio signal based on the form data.

13. A machine readable medium for use in a sound analysis apparatus having a processor for analyzing an input audio signal based on a weighted mixture of a plurality of tone models which represent harmonic structures of sound sources and which correspond to probability density functions of various fundamental frequencies, the machine readable medium containing program instructions executable by the processor for causing the sound synthesis apparatus to perform:

a probability density estimation process of sequentially updating and optimizing respective weights of the plurality of the tone models, so that a mixed distribution of frequencies obtained by the weighted mixture of the plurality of the tone models corresponding to the various fundamental frequencies approximates a distribution of frequency components of the input audio signal, and estimating the optimized weights of the tone models to be a fundamental frequency probability density function of the various fundamental frequencies corresponding to the sound sources; and a fundamental frequency determination process of determining an actual fundamental frequency of the input audio signal based on the fundamental frequency probability density function estimated by the probability density estimation process, wherein the probability density estimation process comprises:

a storage process of storing sound source structure data defining a constraint on one or more of sounds that can be simultaneously generated by a sound source of the input audio signal, a first update process of updating the weights of the tone models corresponding to the various fundamental frequencies a specific number of times for approximating the frequency components of the input audio signal, a fundamental frequency selection process of obtaining fundamental frequencies with peaked weights based on the weights updated by the first update process from the various fundamental frequencies and selecting fundamental frequencies of one or ore more sounds likely to be contained in the input audio signal from the obtained fundamental frequencies with the peaked weights so that the selected fundamental frequencies satisfy the constraint defined by the sound source structure data, and a second update process of imparting a previous distribution to the weights of the tone models corresponding to the various fundamental frequencies so as to emphasize the weights corresponding to the fundamental frequencies selected by the fundamental frequency selection process, and updating the weights of the tone models corresponding to the various fundamental frequencies a specific number of times for further approximating the frequency components of the input audio signal.

* * * * *

UNITED STATES PATENT AND TRADEMARK OFFICE

CERTIFICATE OF CORRECTION

PATENT NO. : 7,754,958 B2
APPLICATION NO. : 11/849232
DATED : July 13, 2010
INVENTOR(S) : Masataka Goto et al.

It is certified that error appears in the above-identified patent and that said Letters Patent is hereby corrected as shown below:

Title Pg, Item (73)

Assignees:

Should read,

National Institute of Advanced Industrial Science and Technology, Tokyo, Japan

Yamaha Corporation, Hamamatsu-shi, Japan

Signed and Sealed this
Thirty-first Day of May, 2011

David J. Kappos

David J. Kappos
*Director of the United States Patent and Trademark Office*